United States Patent [19]

Clinton Falls Township, Steele County et al.

[11] 3,933,019

[45] Jan. 20, 1976

[54] RIVETING DEVICE

[75] Inventors: Gary E. Underland, Clinton Falls Township, Steele County, Thomas Novak, Woodville Township, Waseca County, both of Minn.

[73] Assignee: Borroughs Tool & Equipment Corporation, Kalamazoo, Mich.

[22] Filed: Oct. 4, 1974

[21] Appl. No.: 512,082

[52] U.S. Cl. ..... 72/114; 72/391

[51] Int. Cl.[2] ..... B21J 15/34

[58] Field of Search ..... 72/391, 114, 409, 452

[56] References Cited

UNITED STATES PATENTS

| | | | |
|---|---|---|---|
| 2,324,104 | 7/1943 | Moss | 72/391 |
| 2,358,703 | 9/1944 | Gookin | 72/391 |
| 2,430,563 | 11/1947 | Gill | 72/391 |
| 2,471,598 | 5/1949 | Wilt | 72/391 |
| 2,507,740 | 5/1950 | Tincler | 72/391 |
| 3,328,985 | 7/1967 | Keymer | 72/391 |
| 3,728,882 | 4/1973 | Rigot | 72/114 |

*Primary Examiner*—C. W. Lanham
*Assistant Examiner*—Gene P. Crosby
*Attorney, Agent, or Firm*—Woodhams, Blanchard and Flynn

[57] ABSTRACT

A tool for installing an internally threaded tubular rivet. A pair of levers are pivotally connected together with one of the levers having a portion with a hole therein. A tubular anvil is received in the hole and is secured to the lever. A rod extends axially through the anvil and is relatively movable with respect to the anvil. A knob or the like is mounted on the rod and is spaced axially from the anvil for rotating the rod relative to the anvil. The knob has an abutment thereon which engages the other lever so that a relative movement between the two levers will effect a relative movement between the rod and the anvil.

3 Claims, 5 Drawing Figures

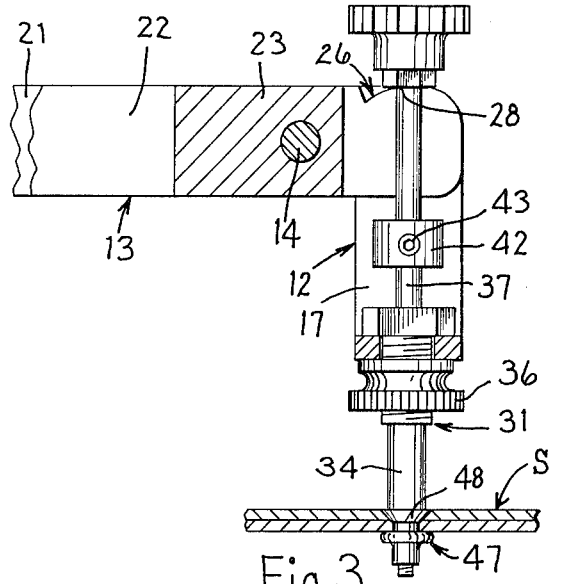
Fig.3
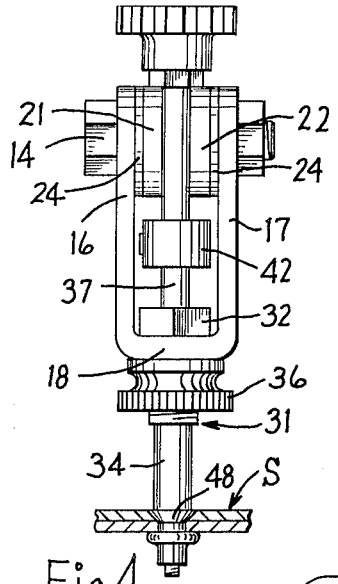
Fig.4
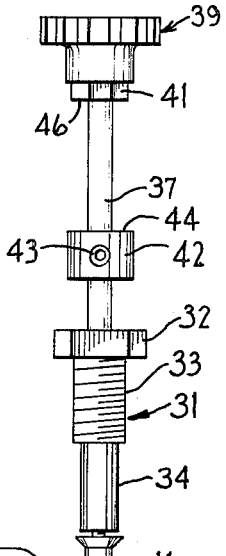
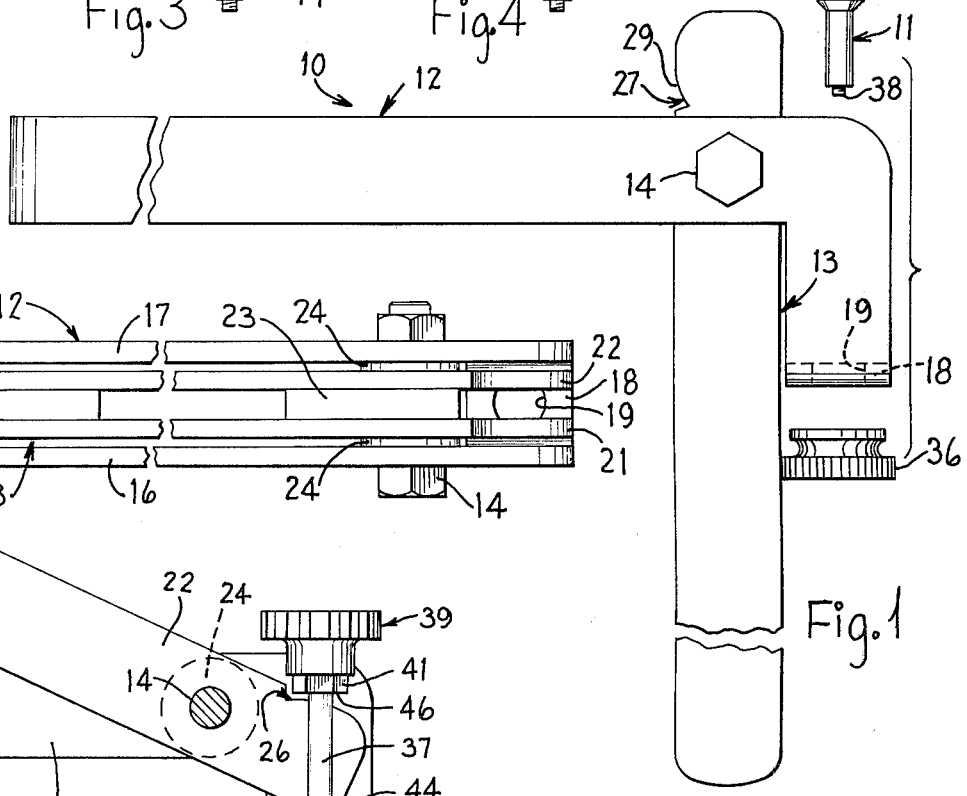
Fig.1
Fig.5
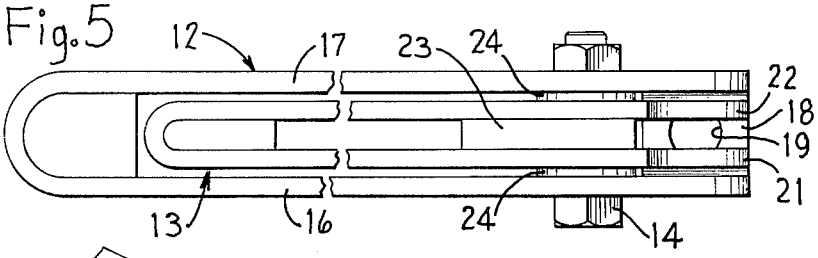
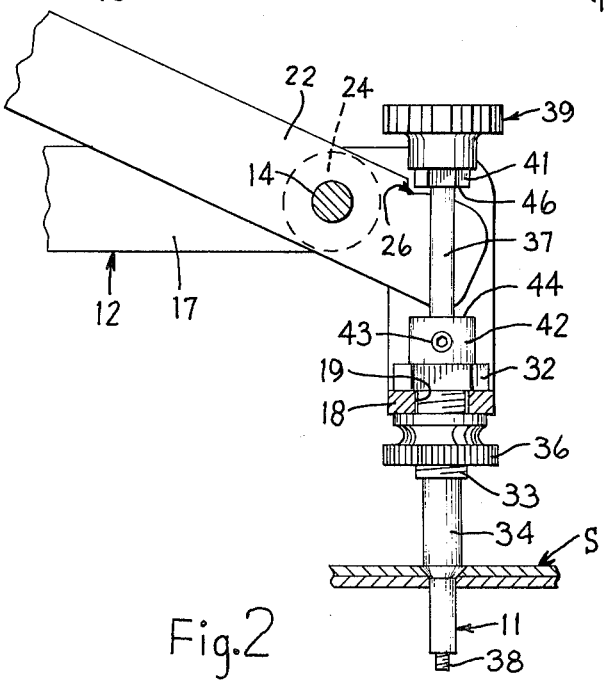
Fig.2

RIVETING DEVICE

FIELD OF THE INVENTION

This invention relates to a tool and, more particularly, to a tool for installing an internally threaded tubular rivet.

BACKGROUND OF THE INVENTION

This invention arose out of a need to improve existing tools for installing internally threaded rivets. Some of the tools which are known in this art are those illustrated in U.S. Pat. Nos. 2,069,907, 2,430,563 and 2,641,378. The tools illustrated in those patents are either awkward to handle or are very expensive to manufacture. Accordingly, it is an object of this invention to provide a tool for installing internally threaded tubular rivets which is both durable and inexpensive to manufacture. It is a further object of this invention to provide a tool, as aforesaid, which is easy to handle and which will facilitate a very rapid installation of the tubular rivets.

Other objects and purposes of this invention will be apparent to persons acquainted with apparatus of this general type upon reading the following specification and inspecting the accompanying drawing.

SUMMARY OF THE INVENTION

In general, the objects and purposes of the invention are met by providing first and second relatively movable levers with the first lever having a portion with means defining a hole therein, the second lever having surface means thereon spaced above the hole and axially aligned therewith. A tubular anvil is mounted in the opening and releasable fastening means are provided for releasably securing the tubular anvil to the first lever. A rod extends axially through the tubular anvil and both the rod and the tubular anvil are capable of axial movement relative to each other. Rotating means on the rod is spaced axially from the anvil for rotating the rod relative to the anvil. The rotating means has an abutment thereon engaging the surface means so that a relative movement between the first and second levers will effect a relative movement between the rod and the anvil.

BRIEF DESCRIPTION OF THE DRAWING

FIG. 1 is a side elevational view in exploded form showing the structure which embodies the invention;

FIG. 2 is an assembled longitudinal central sectional view of the tool;

FIG. 3 is a sectional view like FIG. 2 but with the levers pivoted to effect a deformation of the tubular rivet;

FIG. 4 is an end elevational view of the structure illustrated in FIG. 3; and

FIG. 5 is a top view of the tool without the anvil member.

Certain terminology will be used in the following description for convenience in reference only and will not be limiting. The words "up", "down", "right" and "left" will designate directions in the drawing to which reference is made. The words "in" and "out" will refer to directions toward and away from, respectively, the geometric center of the device and designated parts thereof. Such terminology will include the words above specifically mentioned, derivatives thereof and words of similar import.

DETAILED DESCRIPTION

A tool 10 for installing an internally threaded tubular rivet 11 is illustrated in the drawing. The tool 10 is composed of a pair of levers 12 and 13 which are pivotally interconnected by a bolt 14. The lever 12 consists of a pair of generally parallel arms 16 and 17 (FIG. 4), each of which are L-shaped. The long arm of the L-shaped arms 16 and 17 define a first handle. The free ends of the short legs of the L-shaped arms 16 and 17 are interconnected by a generally horiziontally aligned surface or bight portion 18. A hole 19 extends through the bight portion 18. In this particular embodiment, the axis of the hole 19 extends generally parallel to the longitudinal axis of the short legs of the arms 16 and 17. Further, the bolt 14 extends through aligned holes in the longer legs of the arms 16 and 17.

The lever 13 is U-shaped having a pair of parallel arms 21 and 22 (FIG. 5). The spacing between the arms 21 and 22 adjacent the free ends thereof is maintained by a spacer member 23 illustrated in FIGS. 3 and 5. The spacer 23 and the arms 21 and 22 each have a hole therethrough adapted to receive the bolt 14 therethrough. A pair of washers 24 are utilized for maintaining a proper spacing between the arms of the lever 12 and the arms of the lever 13. The free ends of the arms 21 and 22 are laterally spaced from each other and have along their upper edge a pair of notches 26 and 27 therein. The surfaces 28 and 29 in the notches 26 and 27, respectively, are generally arcuate for a reason which will be explained in more detail below.

A tubular anvil member 31 has an enlarged polygonal-shaped head 32, here a hex-shaped head, at its upper end and an externally threaded portion 33 extending downwardly therefrom. A barrel portion 34 having a smooth external surface extends downwardly below the lower extremity of the thread 33. The diameter of the externally threaded portion 33 and the barrel 34 is slightly smaller than the internal diameter of the hole 19. The enlarged head 32 is, however, larger in diameter than the hole 19 so that when the tubular anvil member 31 is inserted into the hole 19, the enlarged head 32 will limit the location of the anvil 31 relative to the lever 12. A knurled nut 36 having an internal thread therein is threadedly engaged with the external thread 33 on the anvil 31 on the opposite side of the bight portion 18 from the enlarged head 32. The knurled nut 36 is tightened so that the bight portion 18 is clamped between the enlarged head 32 and the knurled nut 36.

As is illustrated in FIG. 4, the lateral spacing between the parallel surfaces on the enlarged head 32 is just slightly smaller than the lateral spacing between the opposed surfaces of the arms 16 and 17 of the lever 12. Thus, the tubular anvil member 31 will not be able to rotate relative to the lever 12 due to the points on the enlarged head engaging the opposed surfaces of the arms 16 and 17.

A rod 37 has a diameter slightly less than the internal diameter of the opening through the tubular anvil member 31. The rod 37 extends through the central portion of the tubular anvil member 31 and is relatively movable with respect thereto. A thread 38 is provided on the lower end of the rod 37. The thread 38 is of an appropriate dimension to threadedly engage the internal thread in the rivet 11. A knurled knob 39 is secured to the upper end of the rod 37. A nut 41 defines an abutment on the lower surface of the knurled knob 39.

A sleeve 42 is sleevably mounted over the rod 37 and is secured in position by a setscrew 43 between the upper surface of the enlarged head 32 and the abutment nut 41. The upper surface 44 of the sleeve 42 is spaced below the lower surface 46 of the abutment nut 41.

OPERATION

Although the operation of the device embodying the invention will be apparent to skilled persons, said operation will be described in detail hereinbelow for convenience.

The levers 12 and 13 are designed to accomodate a variety of different tubular anvil members 31 each having a different diameter rod 37 therein to facilitate the deformation of different sized internally threaded tubular rivets 11. However, only one size of tubular anvil member 31 has been illustrated in the drawing. The tubular anvil member 31 is inserted into the hole 19 in the bight portion 18 of the lever 12. The knurled nut 36 is threaded onto the externally threaded portion 33 of the anvil 31 to clamp the bight 18 between the enlarged head 32 and the knurled nut 36. During this assembly operation, the lever 12 is swung from the position illustrated in FIG. 1 to the position illustrated in FIG. 2 so that the lcwer surface 46 of the abutment nut 41 engages the surfaces 28 and 29 in the notches 26 and 27, respectively. Next, an internally threaded tubular rivet is screwed onto the thread 38 on the lower end of the rod 37. This can be accomplished either by holding the knurled knob 39 in one hand and turning the internally threaded rivet 11 with the other or by holding the rivet 11 stationary and turning the knurled knob 39. The rivet is screwed onto the thread 38 by a sufficient amount so that the upper end of the rivet 11 will engage the lower surface of the barrel 34 of the anvil 31. Further, the rivet 11 must be screwed onto the thread 38 sufficiently far so that the levers 12 and 13 will be at an angle with respect to one another to facilitate a displacement of the rivet material in a hole in a surface S.

The tool 10 is then grasped by the operator by the handles 12 and 13 and moved to a location so that the rivet 11 can be inserted into a hole in a surface S, such as is illustrated in FIG. 2. The operator can then apply pressure to the lever 13 to move it to a position generally parallel with the lever 12, such as is illustrated in FIG. 3. During this movement, the surfaces 28 and 29 in the notches 26 and 27, respectively, will slide relative to the lower surface 46 of the abutment nut 41. Since the surfaces 28 and 29 are arcuate, the sliding transition will be smoothly accomplished. Similarly, the surfaces 28 and 29 will be pivoted upwardly about the axis of the bolt 14 to move the rod 37 upwardly relative to the anvil member 31. Thus, the material of the rivet will be deformed as at 47 so that the enlarged head 48 of the rivet 11 and the deformation 47 will clamp the surface S having the hole therein therebetween.

Thereafter, the knob 39 may be grasped by the operator and rotated to unscrew the thread 38 from engagement with the internal thread in the tubular rivet 11. Thus, the operator may thereafter screw another new rivet 11 onto the thread 38 and the aforementioned procedure can again be repeated.

When it is desired to locate a larger or smaller sized rivet, the anvil member 31 may be removed by removing the knurled nut 36 from engagement with the thread 33. The anvil 31 can thereby be removed from the hole 19 and a new anvil having the desired diameter rod associated therewith inserted into the hole 19. Thus, the assembly procedure discussed above may be repeated.

Although a particular preferred embodiment of the invention has been disclosed in detail for illustrative purposes, it will be recognized that variations or modifications of the disclosed apparatus, including the rearrangement of parts, lie within the scope of the present invention.

We claim:

1. A tool for installing an internally threaded tubular rivet, said tool comprising:

first and second relatively movable levers, said first lever having a portion with means defining a hole therein, said second lever having surface means thereon spaced above said hole and axially aligned therewith;

a tubular anvil having a portion received in said opening, said tubular anvil having enlarged head means defining a radially outwardly extending shoulder thereon, said shoulder engaging said portion of said first lever encircling said hole to locate said anvil relative to said first lever and a threaded portion adjacent said shoulder, said threaded portion being received in said hole and nut means larger in diameter than said hole and having a thread thereon engaged with said threaded portion on said anvil, said nut means engaging said anvil on the opposite side of said portion of said first lever so that said portion of said first lever is clamped between said shoulder and said nut means;

releasable fastening means for releasably securing said tubular anvil to said first lever;

a rod extending axially through said tubular anvil, said rod and said tubular anvil having axial movement relative to each other; and rotating means on said rod spaced axially from said anvil for rotating said rod relative to said anvil, said rotating means having an abutment thereon engaging said surface means whereby a relative movement between said first and second levers will effect a relative movement between said rod and said anvil.

2. A tool for installing an internally threaded tubular rivet according to claim 1, wherein said first lever comprises a pair of laterally spaced arms joined together adjacent one end by said portion having said hole therein; and wherein said second lever has a bifucated portion adjacent one end for straddling said rod below said abutment; and wherein said surface means is defined by a pair of surfaces, one surface on each of said bifurcated ends.

3. A tool for installing an internally threaded tubular rivet according to claim 2, wherein said first and second levers are pivotally secured to each other.

* * * * *